US008412069B2

(12) United States Patent
Kawai et al.

(10) Patent No.: US 8,412,069 B2
(45) Date of Patent: Apr. 2, 2013

(54) CHARGING UNIT, MANUFACTURING METHOD FOR CHARGING UNIT, PROCESS CARTRIDGE AND IMAGE FORMING DEVICE

(75) Inventors: Takeshi Kawai, Kanagawa (JP); Yasuaki Miyazawa, Tokyo (JP); Masato Ono, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 407 days.

(21) Appl. No.: 12/758,380

(22) Filed: Apr. 12, 2010

(65) Prior Publication Data

US 2011/0013928 A1 Jan. 20, 2011

(30) Foreign Application Priority Data

Jul. 16, 2009 (JP) ..... 2009-168118

(51) Int. Cl.
*G03G 15/02* (2006.01)

(52) U.S. Cl. ..... 399/100

(58) Field of Classification Search ..... 399/100, 399/98, 115, 176, 346, 357
See application file for complete search history.

(56) References Cited

U.S. PATENT DOCUMENTS

2007/0104504 A1* 5/2007 Terai et al. ..... 399/100
2009/0067874 A1* 3/2009 Hoshio ..... 399/100
2009/0142677 A1* 6/2009 Shitara et al. ..... 430/48

FOREIGN PATENT DOCUMENTS

JP A-2-272594 11/1990

* cited by examiner

*Primary Examiner* — Walter L. Lindsay, Jr.
*Assistant Examiner* — Rodney Bonnette
(74) *Attorney, Agent, or Firm* — Oliff & Berridge, PLC

(57) ABSTRACT

A charging unit is provided, the charging unit including: a charging member; and a charging member clean-up member having an elastic layer, the elastic layer containing a silicon oil, wherein a silicone concentration in analyzing the charging member by an x-ray photoelectron spectroscopy satisfies following condition: about 1 atm %≦(difference between the maximum value and the minimum value of the silicone concentration in Si2p detected by the x-ray photoelectron spectroscopy above the charging member)≦about 3 atm %.

16 Claims, 6 Drawing Sheets

CHARGING UNIT, MANUFACTURING METHOD FOR CHARGING UNIT, PROCESS CARTRIDGE AND IMAGE FORMING DEVICE

CROSS-REFERENCE TO RELATED APPLICATIONS

This application is based on and claims priority under 35 U.S.C. 119 from Japanese Patent Application No. 2009-168118 filed Jul. 16, 2009.

BACKGROUND

1. Technical Field

The present invention relates to a charging unit, a method for manufacturing the charging unit, a process cartridge and an image forming device.

2. Related Art

In an electro-photographic image forming device, a charge is firstly formed on the surface of an image carrier such as a photoconductive photosensitive body containing an inorganic or organic material, using a charging member, an electrostatic latent image is formed by a laser beam in which an image signal is modulated, and a toner image is visualized by developing the electrostatic latent image with the charged toner. And this toner image is electro-statically transferred via an intermediate transfer body, or directly, onto the recording material such as the recording sheet, and fixed on the recording material to produce a desired image.

In recent years, in the electro-photographic image forming device, a charging roll is mostly used as the charging member for charging the surface of the image carrier as the charged member. The charging roll contacts the image carrier in a state where a voltage is applied, and discharges into a minute gap with the image carrier to charge the surface of the image carrier. The charging roll is strictly controlled in the resistance and shape to charge the image carrier as uniformly as possible.

In the electro-photographic image forming device using the charging member such as the charging roll, the foreign matter such as a transfer remaining toner, an additive of the remaining toner or the paper dust sticking on the surface of the image carrier enters into a nip portion between the charging roll and the image carrier, and sticks onto the surface of the charging roll to contaminate the charging roll.

SUMMARY

According to an aspect of the present invention, there is provided a charging unit, including:

a charging member; and a charging member clean-up member having an elastic layer, the elastic layer containing a silicon oil, wherein a silicone concentration in analyzing the charging member by an x-ray photoelectron spectroscopy satisfies following condition:

about 1 atm %≦(difference between the maximum value and the minimum value of the silicone concentration in Si2p detected by the x-ray photoelectron spectroscopy above the charging member)≦about 3 atm %.

BRIEF DESCRIPTION OF THE DRAWINGS

Exemplary embodiments of the present invention will be described in detail based on the following figures, wherein.

DETAILED DESCRIPTION

An exemplary embodiment of the present invention will be described below. This exemplary embodiment is only illustrative for carrying out the invention, and the invention is not limited to this exemplary embodiment.

<Charging Member, Charging Member Clean-Up Member and Charging Unit>

The shape of a charging member according to this exemplary embodiment is not specifically limited, but may be like the roll, brush, belt (tube), or blade. Among others, the roll shape (what is called a charging roll) is preferable. Also, the shape of a charging member clean-up member is not specifically limited, but may be like the roll or pad. Among others, the roll shape (what is called a cleaning roll) is preferable. In the following, the explanation is given on the premise that the charging member according to this exemplary embodiment is the charging roll, and the charging member clean-up member is the cleaning roll, although the constituent material of each layer for the charging member or charging member clean-up member is also used for the charging member or charging member clean-up member of the other shape.

Figure 1:
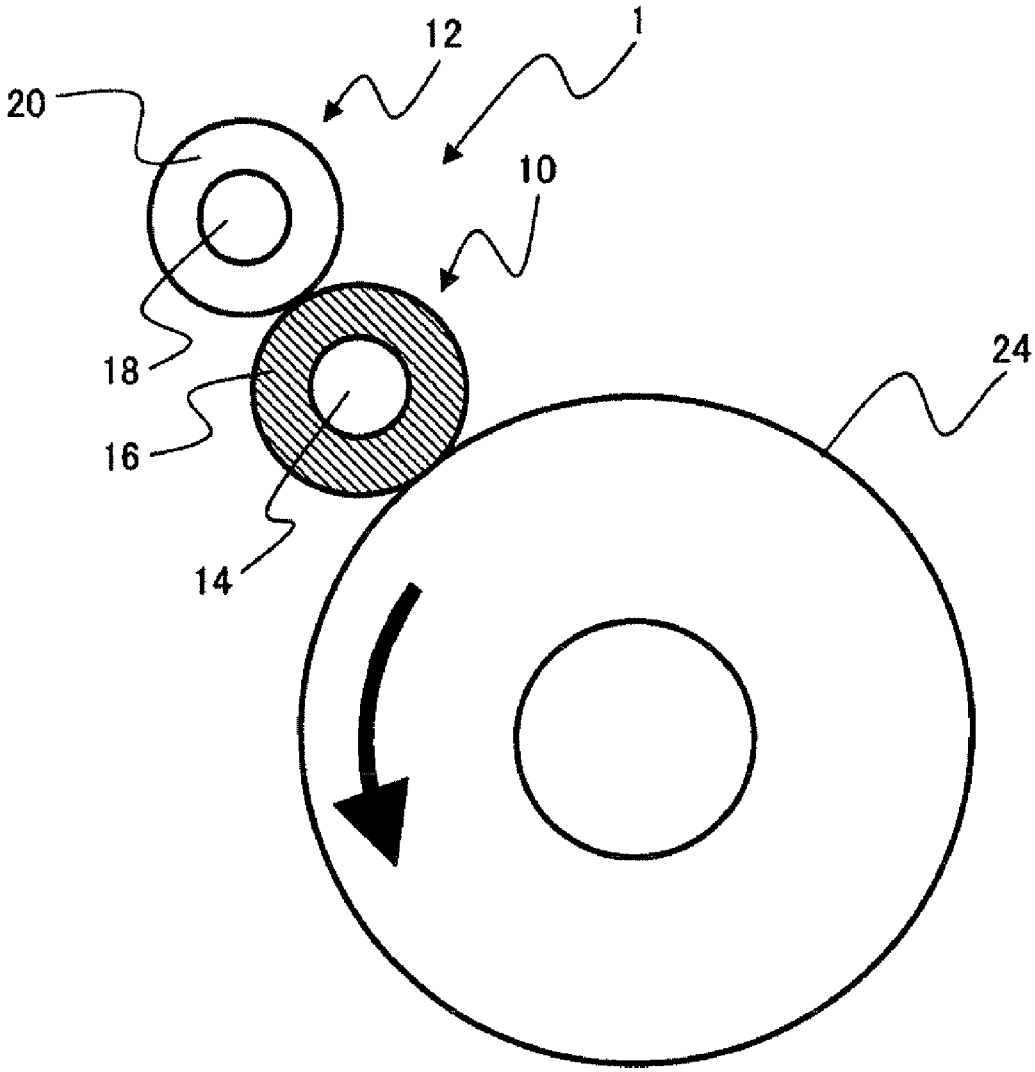
FIG. 1 is a side view showing the schematic constitution of one example of a charging unit according to an exemplary embodiment of the invention.
Figure 2:
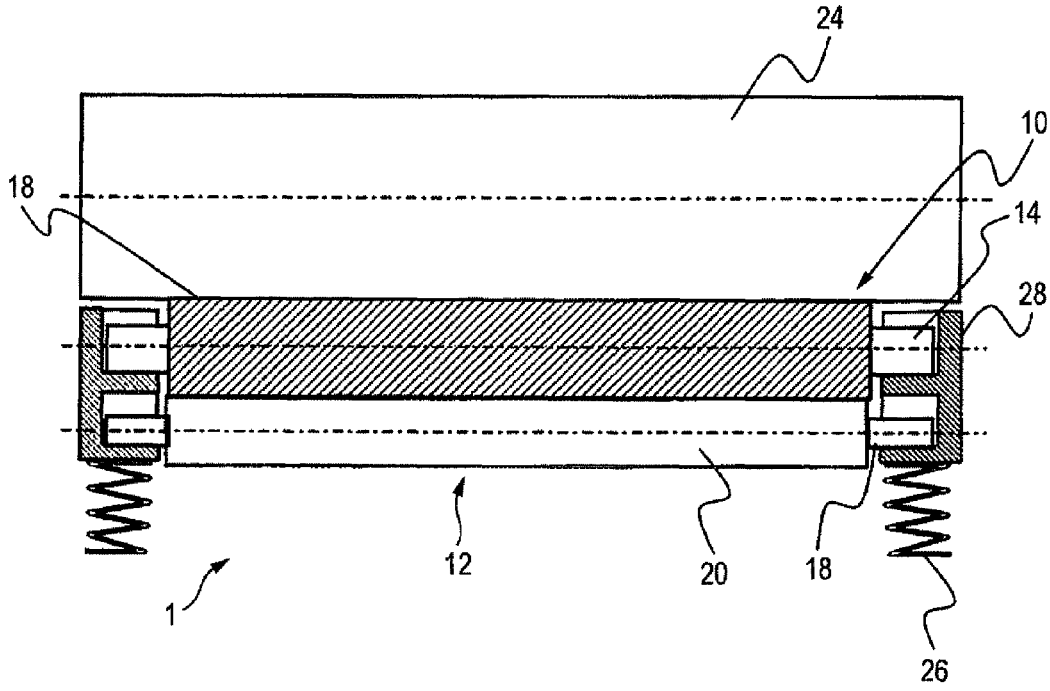
FIG. 2 is a front view showing the schematic constitution of one example of the charging unit according to the exemplary embodiment of the invention.

FIG. 1 is a side view showing the schematic constitution of one example of a charging unit according to the exemplary embodiment of the invention. Also, FIG. 2 is a front view showing the schematic constitution of one example of the charging unit according to the exemplary embodiment. The charging unit 1 of FIG. 1 includes a charging roll 10 that is the charging member for charging the surface of an image carrier provided for an image forming device and is the cylindrical charging member to be rotated around the axis, and a cleaning roll 12 that is the charging member clean-up member for cleaning the surface of the charging roll 10 contacted with the charging roll 10. The charging roll 10 includes a conductive core 14, and a charging layer 16 formed on the outer periphery of the conductive core 14. The charging layer 16 has a conductive elastic layer, and is formed with a surface layer or the like, as needed. The cleaning roll 12 includes a core 18, and a cylindrical elastic layer 20 formed on the outer periphery of the core 18.

In the charging unit 1, the charging roll 10 is pressed against the surface of a photoconductor 24 that is the image carrier by a resilient member such as a coil spring 26 placed at either end of the conductive core 14 for the photoconductor 24, and moved to follow the photoconductor 24, as shown in FIG. 2. On the other hand, the cleaning roll 12 is held by a bearing 28 with a bearing distance between the conductive core 14 of the charging roll 10 and the core 18 of the cleaning roll 12, whereby the cleaning roll 12 is contact with the charging roll 10 with a predetermined intrusion (nip) amount and moved to follow it. The charging roll 10 and the cleaning roll 12 may be moved to follow the photoconductor 24 and the charging roll 10, respectively, or may be driven separately.

In the electro-photographic image forming device using the charging member such as the charging roll, the sticking foreign matter or the like is usually removed by the cleaning roll or cleaning pad as the cleaning member for the charging roll. The cleaning member is a kind of foam in the mainstream due to easiness of removing the foreign matter, in which the material is urethane with small permanent deformation in the mainstream from the viewpoint of the cleaning maintenance. As polyol that is the raw material of urethane, polyether polyol and polyester polyol are well known. Since polyester based polyurethane made from polyester polyol as the raw material is easily hydrolyzed, polyurethane using polyether based polyurethane that is made from polyether polyol as the raw material is mostly used from the viewpoint of storage at high humidity.

Since silicone based foaming agent such as silicone based oil (silicone oil) is usually used in manufacturing polyether based polyurethane, polyether based polyurethane foam may often contain silicone based oil. In the case where this polyether based polyurethane is used as the elastic layer of the charging member clean-up member, there is a tendency to suppress the phenomenon that the foreign matter such as polishing powder occurring in fabricating the elastic layer migrates to the charging member, producing the image quality defect such as color point, because a sliding force between the charging member and the elastic layer of the charging member clean-up member is smaller in cleaning the charging member if there is a smaller amount of silicone based oil contained. However, in the long term storage, the image quality defect such as uneven density may occur because the silicone based oil contaminates the charging roll.

The present inventors found that even if the charging member and the charging member clean-up member are contacted in storage, the charging member is less contaminated and the occurrence of image quality defect such as uneven density or color point is suppressed, while maintaining the cleaning property of the charging member, by regulating the silicone concentration in analyzing the charging member by the x-ray photoelectron spectroscopy, or the silicone concentration in analyzing a contact part and a non-contact part on the charging member by the x-ray photoelectron spectroscopy in a state where the elastic layer of the unused charging member clean-up member and the unused charging member are contacted for one day or more within a specific range as the cleaning member of the charging member.

In the charging unit according to this exemplary embodiment, the elastic layer 20 of the cleaning roll 12 contains silicone oil, in which the silicone concentration in analyzing the charging member 10 by the x-ray photoelectron spectroscopy (XPS analysis) satisfies the following condition, about 1 atm %≦(difference between the maximum value and the minimum value of silicone concentration in Si2p detected by the x-ray photoelectron spectroscopy analysis above the charging member 10)≦about 3 atm %.

Thereby, even in the case where the charging member and the charging member clean-up member are contacted in storage, especially over the long term, the charging member is less contaminated and the occurrence of image quality defect such as uneven density or color point is suppressed, while maintaining the cleaning property of the charging member.

A difference between the maximum value and the minimum value of silicone concentration in Si2p on the charging roll 10 is from 1 or about 1 atm % to 3 or about 3 atm % inclusive, and preferably from 1 or about 1 atm % to 2 or about 2 atm % inclusive. If this difference between the maximum value and the minimum value of silicone concentration does not exceed 3 atm %, the image quality defect such as uneven density does not occur, and if it is not below 1 atm %, a minute sliding force between the charging roll 10 and the cleaning roll 12 does not increase, so that the foreign matter such as polishing powder occurring in fabricating the elastic later 20 of the cleaning roll 12 does not migrate to the charging roll 10 which causes the image quality defect such as color point.

The charging unit according to this exemplary embodiment satisfies the above condition in a state after the charging unit is mounted on the image forming device, or a state where the charging unit is stored or transported during or after manufacturing of the charging unit, for example.

The silicone concentration is specifically decided by cutting the charging layer 16 of the charging roll 10 in parallel to the axial direction of the conductive core 14, at equal intervals and at three points, 3 mm square, and based on a value of ratio of silicone component to all the elements in Si2p, using Photoelectron Spectroscopy Apparatus JPS-9010MX (made by JEOL Ltd.).

Also, in the charging unit according to this exemplary embodiment, the elastic layer 20 of the cleaning roll 12 contains silicon oil, and the silicone concentration in analyzing the contact part and the non-contact part on the charging roll 10 with the elastic layer 20 by the x-ray photoelectron spectrometry in a state where the elastic layer 20 of the unused cleaning roll 12 and the unused charging roll 10 are contacted for one day or more satisfies the following condition.

about 1 atm %≦(difference in the silicone concentration in Si2p between the contact part and the non-contact part of the charging roll 10 with the elastic layer 20 detected by the x-ray photoelectron spectroscopy)≦about 3 atm %.

Thereby, even if the charging member and the charging member clean-up member are contacted in storage, the charging member is less contaminated, and the occurrence of image quality defect such as uneven density or color point is suppressed, while maintaining the cleaning property of the charging member.

The difference in the silicone concentration in Si2p between the contact part and the non-contact part on the charging roll 10 with the elastic layer 20 is from 1 or about 1 atm % to 3 or about 3 atm % inclusive, and preferably from 1 or about 1 atm % to 2 or about 2 atm % inclusive. If this difference in the silicone concentration between the contact part and the non-contact part does not exceed 3 atm %, the image quality defect such as uneven density does not occur, and if it is not below 1 atm %, a minute sliding force between the charging roll 10 and the cleaning roll 12 does not increase, so that the foreign matter such as polishing powder occurring in fabricating the elastic later 20 of the cleaning roll 12 does not migrate to the charging roll 10 which causes the image quality defect such as color point.

The silicone concentration is specifically decided by cutting the contact part and the non-contact part of the charging layer 16 for the charging roll 10 with the elastic layer 20 in parallel to the axial direction of the conductive core 14, at equal intervals and at three points, 3 mm square, and based on a value of ratio of silicone component to all the elements in Si2p, using Photoelectron Spectroscopy Apparatus JPS-9010MX (made by JEOL Ltd.).

Herein, in this specification, the "silicone based oil" has an organopolysiloxane structure. A compound having such structure includes polyoxyalkylene dimethylpolysiloxane copolymer, for example. Such silicone based oil is used as a silicone foaming agent in manufacturing polyurethane, for example.

Also, in this specification, the "unused" refers to the state where the charging unit according to this exemplary embodiment is not used for forming the image. For example, the state where the image formation is not made at all after mounting the charging unit according to this exemplary embodiment on the image forming device, and the state where the image formation is not made at all during manufacturing of the charging unit or during storage or transportation after manufacturing of the charging unit.

Also, in this specification, the "contacted state for one day or more" means that one day or more has passed since the charging layer 16 of the charging roll 10 and the elastic layer 20 of the cleaning roll 12 are contacted, and the charging unit in which one day or more passes since the manufacturing date is estimated as the "contacted state for one day or more".

In the following, each layer making up the charging member clean-up member such as the cleaning roll 12 will be described below. The constitution of the charging member clean-up member is not specifically limited as long as it has a cleaning function of the charging member such as the charging roll, and satisfies this requirement, and preferably is unlikely to cause scar or contamination on the surface of the charging roll like that appearing as the image quality.

The materials used for the core 18 of the roll-like cleaning roll 12 may include a metal such as free-cutting steel and stainless steel, and a resin such as polyacetal (POM). According to the purpose of use such as a sliding property, it is preferable to properly select the material of the core 18 and the surface treating method. Especially in the metal, it is preferable to make the plating treatment form the viewpoint of rust-proofing. Also, the material having no conductivity such as resin may be treated for better conductivity through a typical treatment such as plating, or directly used.

The constitution of the elastic layer 20 on the core 18 may be one layer or two or more layers. The elastic layer 20 may contain a foamed body, or be composed of two layers of a solid layer and a foamed layer. By making the elastic layer 20 capable of cleaning the charging member, it is possible to obtain a function as the cleaning roll.

The material of the elastic layer 20 may be a mixture of one or two kinds of materials including the foaming resin such as polyurethane, polyethylene, polyamide or polypropylene, or the rubber material such as silicone rubber, fluorinated rubber, urethane rubber, ethylene-propylene-diene rubber (EPDM), nitrile rubber (NBR), chloroprene rubber (CR), chlorinated polyisoprene rubber, isoprene rubber, acrylonitrile-butadiene rubber, styrene-butadiene rubber, hydrogenated polybutadiene rubber, butyl rubber and so on. An assistant such as blowing assistant, foaming agent, catalyst, hardener, plasticizer or vulcanization accelerator may be added to them, as needed.

To have less scratch on the surface of the charging member due to rubbing as much as possible, and to prevent fissure or breakage over the long term as much as possible, urethane foam that is strong to tear or tension is preferably used. Examples of polyurethane are not specifically limited, but may include those obtained by reaction of a polyol such as polyester polyol, polyether polyol or acrylic polyol, and an isocyanate such as 2,4-tolylene diisocyanate, 2,6-tolylene diisocyanate, 4,4-diphenylmethane diisocyanate, tolidine diisocyanate or 1,6-hexamethylen diisocyanate. Also, a chain extension agent such as 1,4-butanediol or trimethylolpropane may be mixed. It may be blown using water or a blowing agent of an azo compound such as azodicarbonamide or azobisisobutyronitrile. Further, an assistant such as a blowing assistant, a foaming agent or catalyst may be added, as needed.

The foaming agent may be the silicone foaming agent such as aforementioned silicone based oil.

Usually, a polyether based polyurethane that uses the silicone foaming agent such as the silicone based oil during manufacturing is preferably used as the elastic layer 20 from the point of preventing deterioration due to hydrolysis during storage over the long term.

A method for manufacturing the charging member clean-up member is not specifically limited, but may include an elastic layer forming process of forming the elastic layer and a cleaning process of cleaning the elastic layer, for example. The content amount of silicone based oil in the elastic layer is controlled by cleaning the elastic layer so that the silicone concentration in analyzing the charging member by the x-ray photoelectron spectroscopy, or the silicone concentration in analyzing the contact part and the non-contact part of the charging member by the x-ray photoelectron spectroscopy in a state where the elastic layer of the unused charging member clean-up member and the unused charging member are contacted for one day or more may be made within the specific range as described above.

The cleaning method is not specifically limited, but may include cleaning with a bleaching agent, detergent or super-reduced water. Among others, the bleaching agent is preferred from the viewpoint of removing the silicone component. For example, the bleaching agent contains a component decomposing the coloring mater using the oxidation or reduction reaction of chemical substance, and may be a chlorine beaching agent such as sodium hypochlorite, or an oxygen bleaching agent such as hydrogen peroxide or sodium percarbonate.

The cleaning may be performed by dipping or spraying under the condition at a temperature from 10° C. to 60° C., and for the time from 2 hours to 100 hours, for example.

Next, the charging roll of the charging member will be described below, but is not limited to the following constitution, as long as it has a predetermined charging performance to charge the image carrier as the charged body.

The charging roll 10 includes at least the conductive core 14 and the charging layer 16 containing the elastic layer or resin layer instead of the elastic later. The elastic layer may have a single layer constitution, or a lamination constitution composed of plural different layers having many functions. Further, a surface treatment on the elastic layer may be performed.

The material used for the conductive core 14 may be a metal such as free-cutting steel or stainless steel. It is preferable that the material and the surface treatment method may be properly selected according to the purposes for the sliding property and so on. From the viewpoint of rust prevention, the plating treatment is preferred. The material having no electrical conductivity may be treated for conduction through the typical treatment such as plating, or directly used.

To obtain the predetermined charging performance, the elastic layer is made conductive, but an elastic material such as rubber having elasticity, a carbon black or ion conducting agent for adjusting the resistance of the conductive elastic layer, and a softener, plasticizer, hardener, vulcanizing agent, vulcanization accelerator, antioxidant, filler agent such as silica and calcium carbonate and a material usually added to rubber, as needed, for example, may be added to this conductive elastic layer. The conductive elastic layer is formed by coating a mixture containing a material usually added to rubber on the peripheral surface of a conductive support shaft.

The conducting agent for adjusting the resistance value may be carbon black or ion conducting agent blended in the matrix material in which electrically conducting material is dispersed with at least one of electron and ion as the charge carrier. The above elastic material may be the foamed body.

The elastic material making up the conductive elastic layer may be formed by dispersing the conducting agent in the rubber material, for example. Examples of the rubber material may include isoprene rubber, chloroprene rubber, epichlorohydrin rubber, butyl rubber, urethane rubber, silicone rubber, fluorinated rubber, styrene butadiene rubber, butadiene rubber, nitrile rubber, ethylene propylene rubber, epichlorohydrin ethylene oxide copolymer rubber, epichlorohydrin ethylene oxide allyl glycidyl ether copolymer rubber, ethylene propylene diene three element copolymer rubber (EPDM), acrylonitrile butadiene copolymer rubber, and natural rubber, and a blend rubber thereof. Among others, silicone rubber, ethylene propylene rubber, epichlorohydrin ethylene oxide copolymer rubber, epichlorohydrin ethylene oxide allyl glycidyl ether copolymer rubber, acrylonitrile butadiene copolymer rubber and a blend rubber thereof are preferably used. These rubber materials may or may not be foamed.

As the conducting agent, an electron conducting agent or ion conducting agent may be used. Examples of the electron conducting agent may include minute particles of carbon black such as keten black or acetylene black, pyrolytic carbon, various kinds of conductive metal or alloy such as graphite, aluminum, copper, nickel or stainless steel, various kinds of conductive metal oxide such as tin oxide, indium oxide, titan oxide, tin oxide-antimony oxide solid solution or tin oxide-indium oxide solid solution, or an insulating material having the surface treated for conductivity. Also, examples of the ion conducting agent may include perchlorate or chlorate such as tetraethyl ammonium or lauryl trimethyl ammonium, and perchlorate or chlorate of alkali metal or alkaline earth metal such as lithium or magnesium.

These conducting agents may be used singly, or in combination of two or more kinds. Also, the addition amount is not specifically limited, but is preferably in the range from one to 60 parts by weight to 100 parts by weight of rubber material in the case of the electron conducting agent. On the other hand, in the case of the ion conducting agent, it is preferably in the range from 0.1 to 5.0 parts by weight to 100 parts by weight of rubber material.

The surface of the charging roll 10 may be formed with a surface layer to prevent contamination due to the foreign matter such as toner. The material of the surface layer may be resin or rubber, and is not specifically limited. Examples of this resin or rubber may be polyester, polyimide, copolymer nylon, silicone resin, acrylic resin, polyvinyl butyral, ethylene tetrafluoroethylene copolymer, melamine resin, fluorinated rubber, epoxy resin, polycarbonate, polyvinyl alcohol, cellulose, polyvinylidene chloride, polyvinyl chloride, polyethylene, and ethylene vinyl acetate copolymer.

Among others, polyvinylidene fluoride, 4-ethylene fluoride copolymer, polyester, polyimide and copolymer nylon are preferably used from the viewpoint of preventing contamination with an external additive. The copolymer nylon contains any one or more kinds of nylon 610, nylon 11 and nylon 12 as a polymerization unit, and the other copolymerization units contained in this copolymer may include nylon 6 and nylon 66. Herein, the percentage that the polymerization unit such as nylon 610, nylon 11 and nylon 12 is contained in the copolymer is preferably 10% or more in weight ratio. If the polymerization unit is 10% or more, the liquid compounding property and the film formation property in coating the surface layer are excellent, and there is less wear of the surface layer or less foreign matter sticking to the surface layer especially at the time of repeated uses, whereby the durability of the roll is excellent and the variations in the characteristics due to the environment tend to decrease.

The high molecule materials (resin) may be used singly, or in combination of two or more kinds. Also, the number average molecular weight of the high molecule material is preferably in the range from 1,000 to 100,000, and more preferably in the range from 10,000 to 50,000.

Also, an electrically conductive material may be contained in the surface layer to adjust the resistance value. The electrically conductive material preferably has a particle diameter of 3 μm or less.

Also, as the conducting agent intended to adjust the resistance value, the carbon black or conductive metal oxide particles blended in the matrix material or the ion conducting agent in which the electrically conductive material is dispersed with at least one of electron and ion as the charge carrier may be used.

Examples of the carbon black of the conducting agent may specifically include "Special Black 350", "Special Black 100", "Special Black 250", "Special Black 5", "Special Black 4", "Special Black 4A", "Special Black 550", "Special Black 6", "Color Black FW200", "Color Black FW2" and "Color Black FW2V", which are made by Degussa Co., Ltd, and "MONARCH 1000", "MONARCH 1300", "MONARCH 1400", "MOGUL-L" and "REGAL 400R", which are made by Cabot Corporation.

The above carbon black has pH4.0 or less, and a more excellent dispersion property into the resin composite element due to the effect of an oxygen containing functional group existent on the surface than the typical carbon black, whereby the charging uniformity is improved and further the variations in the resistance value tend to decrease by blending the carbon black of pH4.0 or less.

The conductive metal oxide particles that are conductive particles for adjusting the resistance value are particles having conductivity such as tin oxide, tin oxide doped with antimony, zinc oxide, anatase titanium oxide or ITO, in which any of the conducting agents may be used as long as the electron is the charge carrier, without specific limitation. They may be used singly or in combination of two or more kinds. Also, any particle diameter may be used as long as the effects of this exemplary embodiment are not impeded. From the viewpoint of adjusting the resistance value or the strength, the preferable metal oxides are tin oxide, tin oxide doped with antimony, and anatase titanium oxide, and the more preferable metal oxides are tin oxide and tin oxide doped with antimony.

By controlling the resistance with such conductive materials, the resistance value of the surface layer does not change under the environmental conditions, whereby the stable characteristics can be obtained.

Further, the surface layer uses fluorine based or silicone based resin, and particularly, preferably contains fluorine denatured acrylate polymer. Also, minute particles may be added into the surface layer. Thereby, the surface layer becomes hydrophobic, and acts to prevent the foreign matter from sticking to the charging roll. Also, the surface of the charging roll may be made irregular by adding insulating particles of alumina or silica, reducing the load in sliding with the photosensitive drum, and improving the wear resistance between the charging roll and the image carrier.

The outer diameter of the charging roll 10 is preferably from 8 mm to 16 mm. From the viewpoint of reducing the size of the image forming device, it is preferably ϕ14 mm or less, and if it is ϕ8 mm or less, the number of contacts with the external additive a position on the peripheral surface of the charging roll increases, and the number of discharges increases, which may be often disadvantageous for the long term stability. Also, a measurement method for the outer diameter may be made using the commercially available calipers, or a laser outer diameter measuring instrument.

The micro-hardness of the charging roll 10 is preferably from 45° to 60°. If the hardness is beyond 60°, it is difficult to secure the nip stability with the image carrier, even if the charging member clean-up member is attached, whereby the uneven density of the image quality may occur in some cases. If the hardness is below 45°, the nip stability with the image carrier is secured, even if the charging member clean-up member is not provided. However, to lower the hardness, a method for increasing the addition amount of plasticizer or a method for using the material having low hardness such as silicone rubber may be conceived. In the former case, the plasticizer bleeds, possibly causing a problem of degraded image quality. In the latter case, the great cost up may occur.

Also, the micro-hardness of the charging roll 10 may be measured by an MD-1 type hardness meter made by High Molecular Instrument.

<Process Cartridge>

A process cartridge according to this exemplary embodiment includes the image carrier, and the charging unit having the charging member for charging the surface of the image carrier, and the charging member clean-up member for cleaning the surface of the charging member in contact with the charging member. The process cartridge of this exemplary embodiment may include at least one kind selected from a group consisting of a latent image forming unit that forms a latent image on the surface of the charged image carrier, a development unit that developing the latent image formed on the surface of the image carrier with the toner to form a toner image, a transfer unit that transfers the toner image formed on the surface of the image carrier to the transferred body, and an image carrier cleaning unit that cleans the surface of the image carrier after transfer, as needed.

Figure 3:
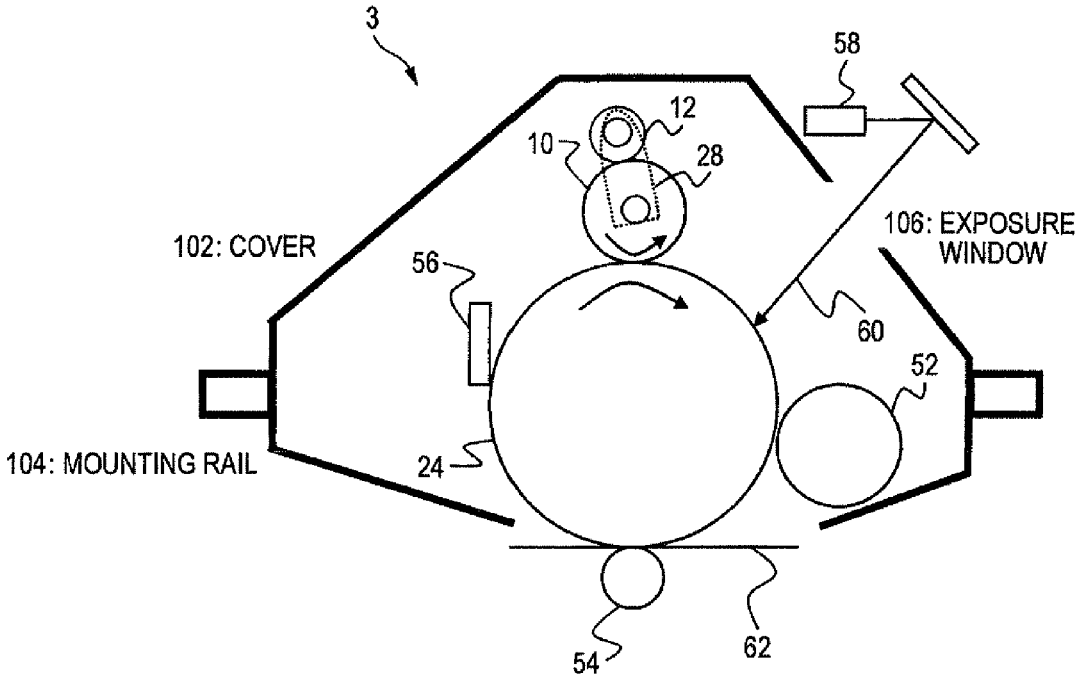
FIG. 3 is a schematic constitutional view showing one example of a process cartridge according to the exemplary embodiment of the invention.

FIG. 3 shows a schematic constitution of one example of the process cartridge according to the exemplary embodiment of the invention. This constitution will be described below. The process cartridge 3 integrally bears the photoconductor (electro-photographic photosensitive member) 24 as the image carrier on which the latent image is formed, the cylindrical charging roll 10 as the charging member for charging the surface of the photoconductor 24 in contact therewith, the cleaning roll 12 as the charging member clean-up member for cleaning the surface of the charging roll 10 in contact with the charging roll 10, a developing roll 52 as a developing unit that develops the latent image formed on the surface of the photoconductor 24 with the toner to form the toner image, and a cleaning blade 56 as a image carrier cleaning unit that cleans out the toner remaining on the photoconductor 24 after transfer in contact with the surface of the photoconductor 24 in a cover 102, and can be removably mounted on the image forming device by a mounting rail 104. When mounted on the image forming device, the charging roll 10, an exposure unit 58 as a latent image forming unit that forms the electrostatic latent image on the surface of the photoconductor 24 by a laser beam or reflected light of the original through the exposure window 106 placed at the cover 102, the developing roll 52, a transfer roll 54 as a transfer unit that transfers the toner image on the surface of the photoconductor 24 onto the recording sheet 62 of the transferred body, and the cleaning blade 56 are disposed in this order around the periphery of the photoconductor 24. The silicone concentration in analyzing the charging roll 10 by the x-ray photoelectron spectroscopy, or the silicone concentration in analyzing the contact part and the non-contact part on the charging roll by the x-ray photoelectron spectroscopy in a state where the elastic layer of the unused cleaning roll 12 and the unused charging roll 10 are contacted for one day or more is within the prescribed range, as previously described. In FIG. 3, the other functional units that are usually needed in the photo-electrographic process are omitted from the drawing.

The operation of the process cartridge 3 according to this exemplary embodiment will be described below.

First of all, the surface of the photoconductor 24 is uniformly charged at a high potential by feeding a voltage from a high voltage power source (not shown) to the charging roll 10 in contact with the surface of the photoconductor 24. At this time, the photoconductor 24 and the charging roll 10 are rotated in the arrow direction of FIG. 3. After charging, if an image light (exposure) 60 according to the image information is applied to the surface of the photoconductor 24 by the exposure unit 58, an applied part has the decreased potential. Since the image light 60 has a distribution of light quantity according to black/white of the image, a potential distribution corresponding to the recorded image, namely, an electrostatic latent image, is formed on the surface of the photoconductor 24 by application of the image light 60. If a portion where the electrostatic latent image is formed passes through the developing roll 52, the toner is deposited according to the low or high level of the potential, forming the toner image in which the electrostatic latent image is visualized.

The recording sheet 62 is conveyed to the portion where the toner image is formed at a predetermined timing by a registration roll (not shown), and overlaid on the toner image on the surface of the photoconductor 24. After this toner image is transferred onto the recording sheet 62 by the transfer roll 54, the recording sheet 62 is separated from the photoconductor 24. The separated recording sheet 62 is conveyed on the conveying path, heated, pressurized and fixed by a fixing unit (not shown) as a fixing unit, and exhausted out of the apparatus.

The cleaning roll 12 is installed in the charging roll 10 provided in the process cartridge 3, and if a voltage is applied from the high voltage power source to a bearing 30, the foreign matter is shifted without being accumulated on the surface of the cleaning roll 12 and the charging roll 10 because of the cleaning roll 12 having electrically the same polarity as the charging roll 10, and withdrawn by the cleaning blade 56, whereby the foreign matter such as the toner adhering to the charging member can be stably removed over the long term. Therefore, the dirt is hardly accumulated on the charging roll 10 over the long term, whereby the stable charging performance can be kept.

The photoconductor 24 has at least a function of being formed with the electrostatic latent image (electrostatic charge image). The electro-photographic photoconductor is formed with an under coating layer, a charge generation layer containing the charge generation substance, and a charge transport layer containing the charge transport substance in this order on the peripheral surface of the cylindrical conductive base, as needed. The order of laminating the charge generation layer and the charge transport layer may be reversed. They are a laminated photoconductor in which the charge generation substance and the charge transport substance are contained in different layers (charge generation layer and charge transport layer) and laminated, but may be a monolayer type photoconductor in which both the charge generation substance and the charge transport substance are contained in the same layer. Preferably, it is the laminated photoconductor. Also, an intermediate layer may be provided between the under coating layer and the photosensitive layer. Also, a protective layer may be provided on the photosensitive layer. Also, other kinds of the photosensitive layer such as an amorphous silicone photosensitive film may be used in addition to an organic photoconductor.

The exposure unit 58 is not specifically limited, but may be an optical system apparatus such as a laser optical system or LED array capable of performing exposure from a light source such as a semiconductor laser beam, an LED light or a liquid crystal shutter light, like a desired image to the surface of the photoconductor 24, for example.

The developing unit has a function of developing the electrostatic latent image formed on the photoconductor 24 with a one-component developer or two-component developer containing an electrostatic charge image development toner to form the toner image. Such development device is not specifically limited, as long as it has the above function, and may be properly selected according to the purposes, whether the toner layer contacts the photoconductor 24 or not. For example, a developing unit having a function of applying the electrostatic charge image developing toner to the photoconductor 24 using the developing roll 52 as shown in FIG. 3, or a developing unit having a function of applying the toner to the photoconductor 24 using a brush are well known.

The transfer unit may transfer the image to the paper directly or via an intermediate transfer body. For example, the transfer roll 54 and a transfer roll pressing device (not shown) using a conductive or semi-conductive roll for transferring the image to the recording sheet 62 in contact therewith may be used as shown in FIG. 3. Also, the charge having the reverse polarity to that of the toner may be supplied to the recording sheet 62 from the back of the recording sheet 62 (opposite side of the photoconductor), and the toner image may be transferred to the recording sheet 62 owing to an electrostatic force. The transfer roll 54 may be optionally set up depending on an image area width to be charged, the shape of the transfer charging unit, the aperture width, and the process speed (peripheral speed). Also, to reduce the cost, a monolayer foam roll as the transfer roll 54 is suitably employed.

The fixing unit is not specifically limited, as long as it fixes the toner image transferred onto the recording sheet 62 by heating, pressurization or heating and pressurization.

The recording sheet 62 of the transferred body onto which the toner image is transferred may be the plain paper or OHP sheet used for an electro-photographic copying machine or printer, for example. To further improve the smoothness on the image surface after fixing, the surface of the transfer material is preferably as smooth as possible. For example, the coated paper in which the surface of the plain paper is coated with resin and the art paper for printing are suitably used.

<Image Forming Device>

An image forming device according to this exemplary embodiment includes the image carrier, the charging unit having the charging member that charges the surface of the image carrier and the charging member clean-up member that cleans the surface of the charging member in contact with the charging member, a latent image forming unit that forms a latent image on the surface of the image carrier, and a development unit that develops the latent image formed on the surface of the image carrier with a toner to form a toner image. The image forming device of this exemplary embodiment may include at least one kind selected from a group consisting of a transfer unit that transfers the toner image formed on the surface of the image carrier to the transferred body and an image carrier cleaning unit that cleans the surface of the image carrier after transfer, as needed. Also, the image forming device according to this exemplary embodiment may use the above process cartridge.

Figure 4:
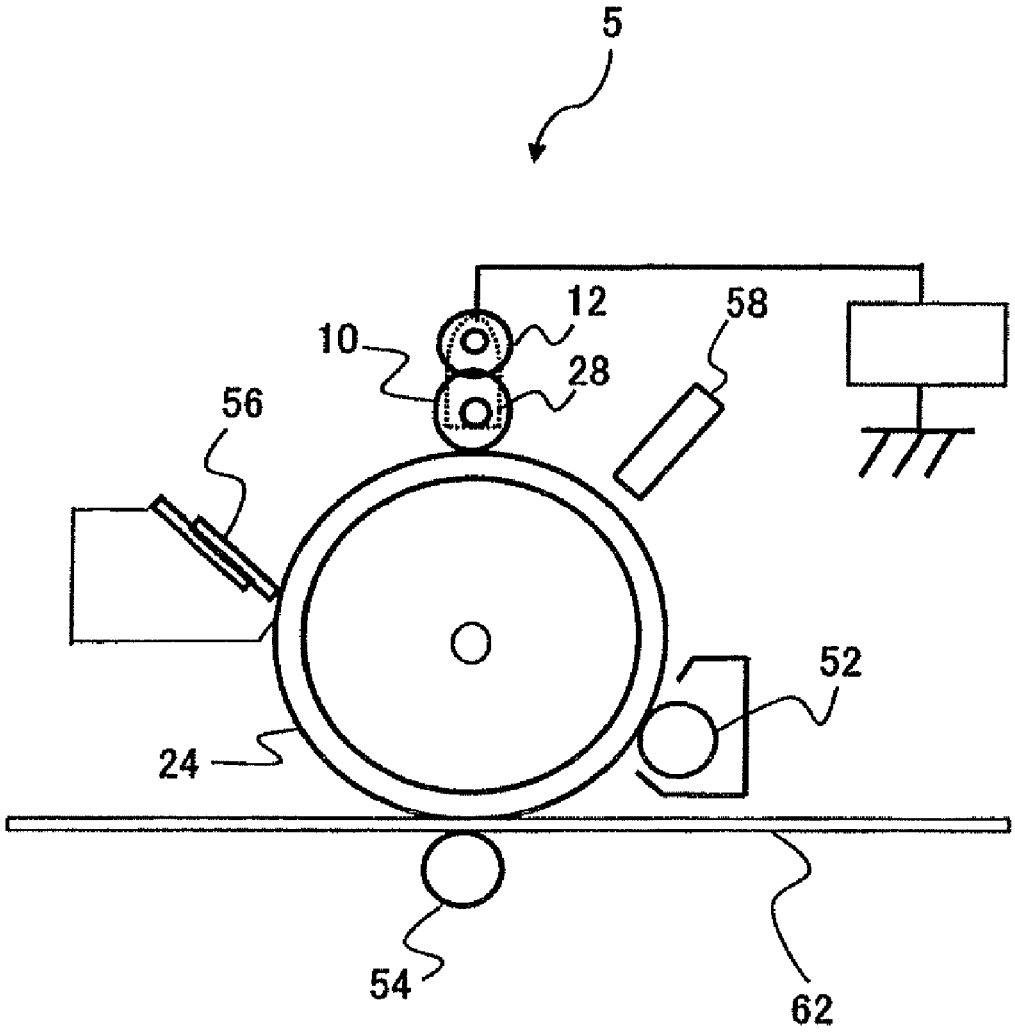
FIG. 4 is a schematic constitutional view showing one example of an image forming device according to the exemplary embodiment of the invention.

FIG. 4 shows a schematic constitution of one example of the image forming device according to the exemplary embodiment. The constitution will be described below. The image forming device 5 includes the photoconductor 24 as the image carrier on which the electrostatic latent image is formed, the cylindrical charging roll 10 as the charging member that charges the surface of the photoconductor 24 in contact therewith, the cleaning roll 12 as the charging member clean-up member that contacts the charging roll 10 and cleans the surface of the charging roll 10, the exposure unit 58 as the latent image forming unit that forms the electrostatic latent image on the surface of the photoconductor 24 by a laser beam or reflected light of the original, the developing roll 52 as the developing unit that develops the electrostatic latent image formed on the surface of the photoconductor 24 with the toner to form the toner image, the transfer roll 54 as the transfer unit that transfers the toner image on the surface of the photoconductor 24 to the recording sheet 62 as the transferred body, and the cleaning blade 56 as the image carrier cleaning unit that cleans out the toner remaining on the photoconductor 24 after transfer in contact with the surface of the photoconductor 24. In the image forming device 5, the charging roll 10, the exposure unit 58, the developing roll 52, the transfer roll 54, and the cleaning blade 56 are disposed in this order around the periphery of the photoconductor 24. The silicone concentration in analyzing the charging roll 10 by the x-ray photoelectron spectroscopy, or the silicone concentration in analyzing the contact part and the non-contact part of the charging roll by the x-ray photoelectron spectroscopy in a state where the elastic layer of the unused cleaning roll 12 and the unused charging roll 10 are contacted for one day or more is within the prescribed range, as previously described. In FIG. 4, the other functional units that are usually needed in the photo-electrographic process are omitted from the drawing. Each constitution of the image forming device 5 and the operation of forming the image are the same as the process cartridge 3 of FIG. 3.

Figure 5:
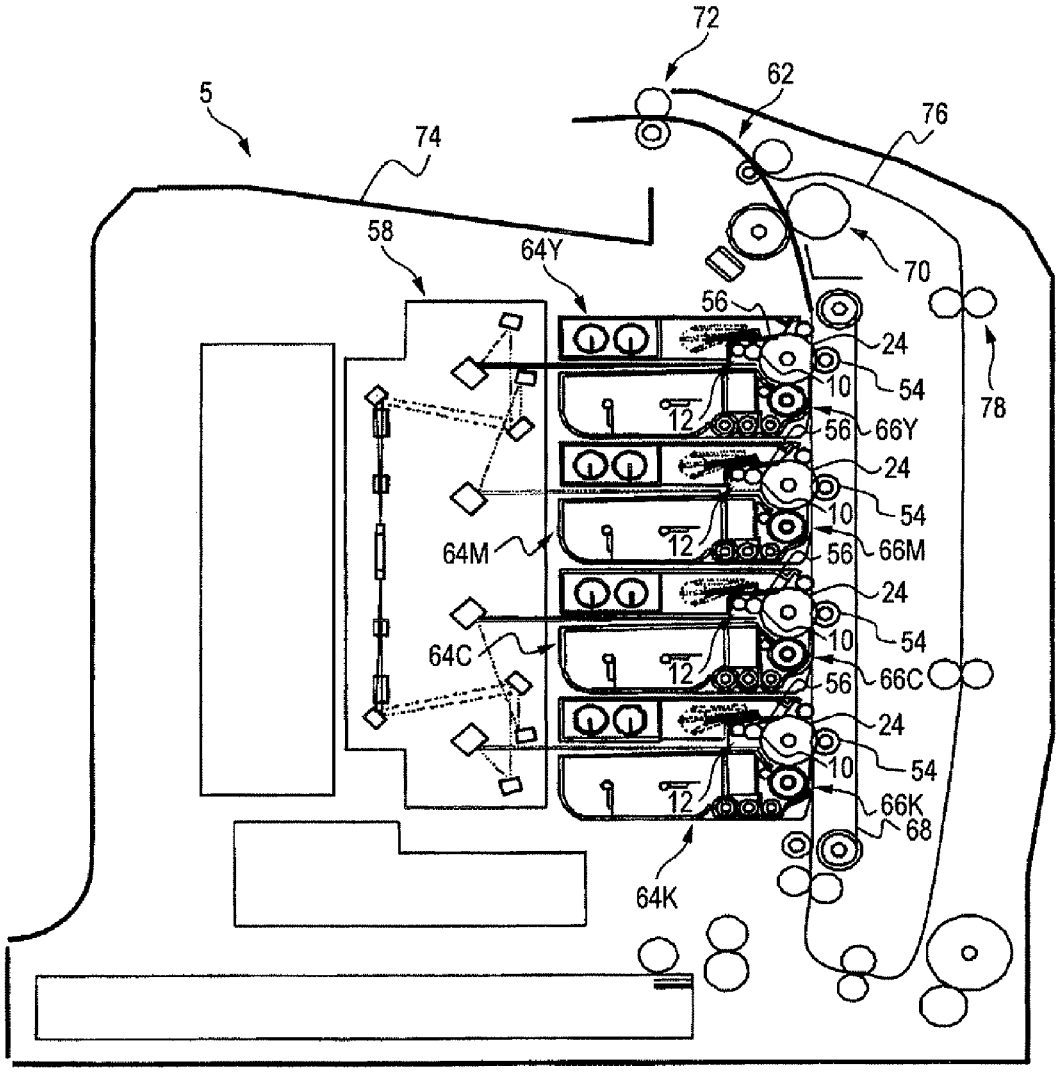
FIG. 5 is a schematic constitutional view showing another example of the image forming device according to the exemplary embodiment of the invention.

FIG. 5 shows the full-color image forming device 5 of tandem type. The photoconductor (photosensitive drum) 24, the charging roll 10 and the developing unit are arranged for each color of yellow (64Y), magenta (64M), cyan (64C) and black (64K) as the state of cartridge inside this image forming device 5. This photoconductor 24 is composed of a conductive cylinder having a diameter of about 25 mm and covered with a photosensitive layer on the surface, for example, and driven and rotated at a process speed of about 150 mm/sec by a motor, not shown.

After the surface of the photoconductor 24 is charged at a predetermined potential by the charging roll 10 disposed sideways of the photoconductor 24, the image exposure is performed by a laser beam emitted from the exposure unit 58, so that the electrostatic latent image according to the image information is formed.

The electrostatic latent image formed on this photoconductor 24 is developed by the developing unit 66Y, 66M, 66C, 66K for each color of yellow (Y), magenta (M), cyan (C) and black (K) to become the toner image of predetermined color.

For example, in forming the full-color image, each process of the charging, exposure, and development is performed corresponding to each color of yellow (Y), magenta (M), cyan (C) and black (K) on the surface of the photoconductor 24 for each color, so that the toner image corresponding to each color of yellow (Y), magenta (M), cyan (C) and black (K) is formed on the surface of the photoconductor 24 for each color.

The toner image of each color of yellow (Y), magenta (M), cyan (C) and black (K) successively formed on the photoconductor 24 is transferred onto the recording paper 62 conveyed on a sheet conveying belt 68 around the periphery of the photoconductor 24. Further, the recording paper 62 onto which the toner image is transferred from the photoconductor 24 is conveyed to the fixing device 70, and heated and pressurized by this fixing device 70 to fix the toner image on the recording paper 62. Thereafter, in the single-sided printing, the recording paper 62 on which the toner image is fixed is directly outputted on to an output tray 74 provided on the top of the image forming device 5 by an exhaust roll 72.

On the other hand, in the double-sided printing, the recording paper 62 in which the toner image is fixed on the first face (surface) by the fixing device 70 is not directly exhausted on to the output tray 74 by the exhaust roll 72, but the exhaust roll 72 is reversely rotated in a state where the rear end of the recording paper 62 is pinched by the exhaust roll 72, the conveying path of the recording paper 62 is switched to a sheet conveying path 76 for the double-sided printing, and the recording paper 62 is turned upside down by a conveying roll 78 disposed on the sheet conveying path 76 for the double-sided printing, and conveyed onto the paper conveying belt 68 again, whereby the toner image is transferred from the photoconductor 24 onto the second face (back) of the recording paper 62. And the toner image on the second face (back) of the recording paper 62 is fixed by the fixing device 70, and the recording paper 62 is outputted on to the output tray 74.

On the surface of the photoconductor 24 after the transfer process for the toner image is ended, the remaining toner or paper dust is removed by the cleaning blade 56 arranged obliquely above the photoconductor 24, every time the photoconductor 24 is rotated once, whereby the next image forming process is prepared.

Figure 6:
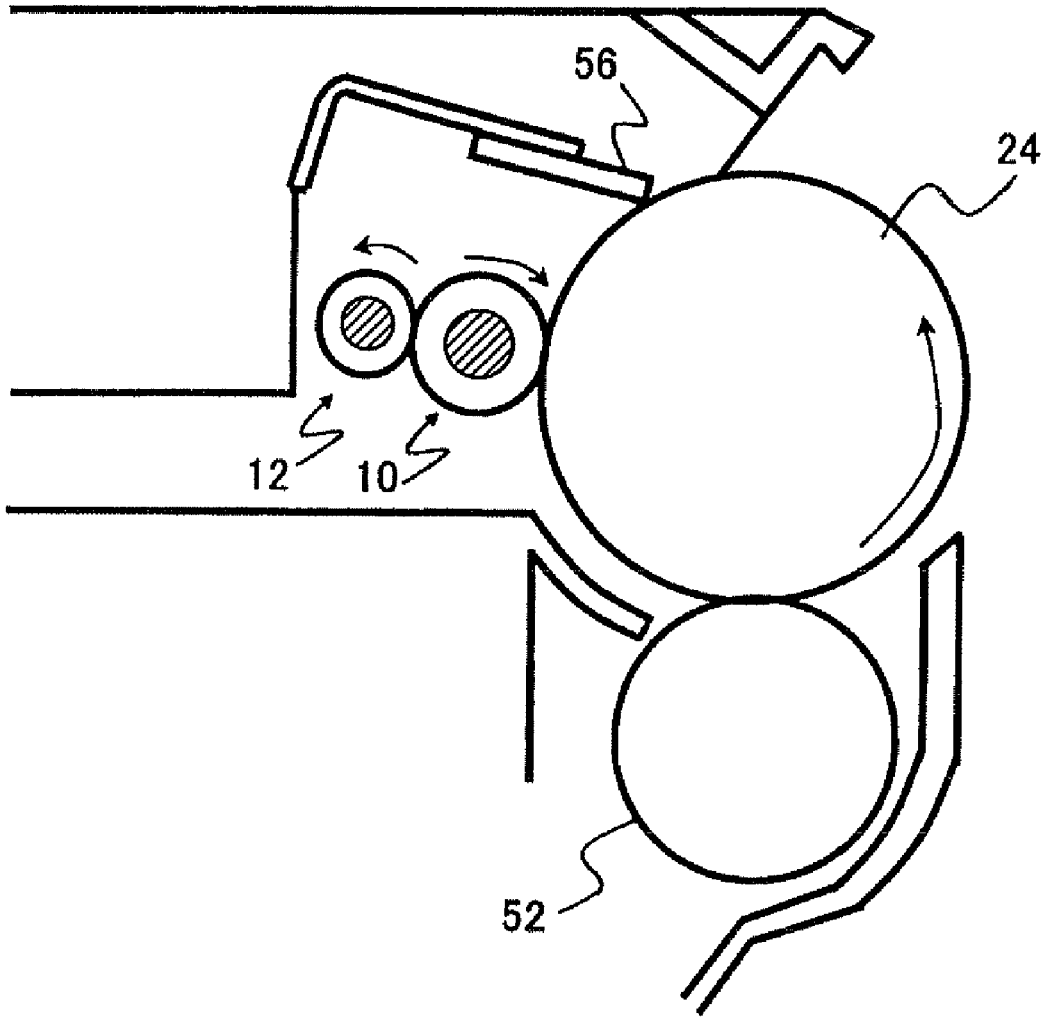
FIG. 6 is a schematic constitutional view showing the charging unit in the image forming device of FIG. 5.

The charging roll 10 is disposed to be in contact with the photoconductor 24 sideways of the photoconductor 24, as shown in FIG. 6. This charging roll 10 is supported rotatably. The cleaning roll 12 for the charging roll 10 is in contact with the charging roll 10 on the opposite side of the photoconductor 24. The cleaning roll 12 is supported rotatably. The silicone concentration in analyzing the charging roll 10 by the x-ray photoelectron spectroscopy, or the silicone concentration in analyzing the contact part and the non-contact part of the charging roll by the x-ray photoelectron spectroscopy in a state where the elastic layer of the unused cleaning roll 12 and the unused charging roll 10 are contacted for one day or more is within the prescribed range, as previously described.

The charging roll 10 is pressed against the photoconductor 24 with a predetermined load applied on both ends of the conductive core, and undergoes an elastic deformation along the peripheral surface of the charging layer to form a nip part. Further, the cleaning roll 12 is pressed against the charging roll 10 with a predetermined load applied on both ends of the core, to form a nip part because the elastic layer undergoes an elastic deformation along the peripheral surface of the charging roll 10, whereby the nip uniformity in the axial direction between the charging roll 10 and the photoconductor 24 is maintained by suppressing flexure of the charging roll 10.

The present invention will be more specifically described below using the examples and the comparative examples, but is not limited to the following examples.

Example 1

(Fabricating the Cleaning Roll)

After a foam urethane sheet (made by Inoack Corporation, EPM70, polyether based polyurethane) made of polyether polyol as the material and containing a silicone foaming agent is processed into a predetermined size, a hole is drilled in the sheet, and a core having an outside diameter of ϕ6 mm with an adhesive applied is inserted into the hole and bonded by heating. After cooling, the cleaning roll is fabricated by polishing. This cleaning roll has an outside diameter of ϕ10 mm, a thickness of 2 mm, and a length of 315 mm. This cleaning roll is dipped into the bleaching agent, Haiter made by Kao Corporation, and left away at 25° C. for 24 hours. Thereafter, the cleaning roll is obtained by sufficiently cleaning it in the ion-exchanged water.

(Fabricating the Charging Roll)

[Forming the Elastic Layer]

The following mixture is kneaded by an open roll, cylindrically covered on the surface of a conductive core having a diameter of 6 mm and composed of SUS416 to have a thickness of 3 mm, put into a cylindrical mould having an inner diameter of 18.0 mm, vulcanized at 170° C. for 30 minutes, taken out of the mould, and then polished to obtain the cylindrical conductive elastic layer.

| | |
|---|---|
| Rubber material (epichlorohydrin ethylene oxide allyl glycidyl ether copolymer rubber, Gechron3106: made by Nippon Zeon, 75 parts by weight and nitrile butadiene rubber, N250S: made by JSR Corporation, 25 parts by weight) | 100 parts by weight |
| Conducting agent (benzyl chloride triethylammonium: made by Kanto Chemical Co., Inc.) | 0.9 parts by weight |
| Conducting agent (Ketjenblack EC: made by Lion Corporation) | 15 parts by weight |
| Vulcanizing agent (sulfur, 200 mesh: made by Tsurumi Chemical Co., Ltd.) | 1 parts by weight |
| Vulcanization accelerator (Nocseller DM: made by Ouchi Shinko Chemical Industrial CO., LTD) | 2.0 parts by weight |
| Vulcanization accelerator (Nocseller TT: made by Ouchi Shinko Chemical Industrial CO., LTD) | 0.5 parts by weight |

[Forming the Surface Layer]

A dispersion solution obtained by dispersing the following mixture with a beams mill is diluted by methanol, dipped and coated on the surface of the conductive elastic layer, and heated and dried at 140° C. for 15 minutes to form a surface layer having a thickness of 10 μm to obtain the charging roll.

| | |
|---|---|
| High molecule material (N-methoxy methyl Nylon, F30K: made by Nagase ChemteX Corporation) | 100 parts by weight |
| High molecule material (polyvinyl butyral resin, Esrec BL-1: made by Sekisui Chemical Co., Ltd.) | 10 parts by weight |
| Conducting agent (Carbon Black, KetjenBlack EC: made by Lion Corporation) | 20 parts by weight |
| Porous filler (polyamide resin grain, 2001UDNAT1: made by Arkema) | 30 parts by weight |

-continued

| | |
|---|---|
| Catalyst (phosphoric acid dissociation, isopropanol/isobutanol catalyst, NACURE4167: made by King Industries, Inc) | 7 parts by weight |
| Solvent (methanol) | 900 parts by weight |

Example 2

(Fabricating the Cleaning Roll)

The cleaning roll is fabricated in the same way as in the example 1 except that it is dipped in the bleaching agent for 8 hours.

Example 3

(Fabricating the Cleaning Roll)

The cleaning roll is fabricated in the same way as in the example 1, except that it is dipped in the bleaching agent for 16 hours.

Example 4

(Fabricating the Cleaning Roll)

The cleaning roll is fabricated in the same way as in the example 1, except that it is dipped in the bleaching agent for 16 hours, using a urethane foam sheet (made by Inoac Corporation, SP-80, polyester based polyurethane) made of polyester polyol as the material and containing a silicone foaming agent.

Example 5

A cleaning pad is fabricated by punching the urethane foam into a desired size. This cleaning pad had a thickness of 2 mm and a length of 30 mm×320 mm. This cleaning pad is dipped in the bleaching agent, Halter made by Kao Corporation, and left away for 16 hours. Thereafter, the cleaning pad is obtained by sufficiently cleaning it in the ion-exchanged water.

Comparative Example 1

(Fabricating the Cleaning Roll)

The cleaning roll is fabricated in the same way as in the example 1, except that it is not dipped in the bleaching agent and not cleaned in the ion-exchanged water.

Comparative Example 2

(Fabricating the Cleaning Roll)

The cleaning roll is fabricated in the same way as in the example 1, except that it is not dipped in the bleaching agent and not cleaned in the ion-exchanged water, using a urethane foam sheet (made by Inoac Corporation, RSM55, polyester based polyurethane) made of polyester polyol as the material and not containing the silicone foaming agent.

Comparative Example 3

(Fabricating the Cleaning Roll)

The cleaning roll is fabricated in the same way as in the example 1, except that it is dipped in the bleaching agent for 60 hours.

<Evaluation>

(Measuring the Silicone Concentration (Difference Between the Maximum Value and the Minimum Value) in Si2p by the XPS Analysis)

The cleaning roll or cleaning pad and the charging roll which are fabricated in the examples 1 to 5 and the comparative examples 1 to 3 are mounted on a process cartridge for a color copying machine DocuCentre Color 400CP (made by Fuji Xerox Co., Ltd.) reconstructed to allow the cleaning roll for the charging roll to be mounted. After the process cartridge is left away for three days, the printing is made for 1000 sheets, the charging roll is taken out, the charging layer is cut in parallel to the axial direction of the conductive core, at equal intervals and three points, 3 mm square, and the silicone concentration in Si2p is measured using a photoelectron spectrometer JPS-9010MX (made by JEOL Ltd.).

(Measuring the Silicone Concentration (Difference Between the Nip Part and the Non-Nip Part) in Si2p by the XPS Analysis)

The cleaning roll or cleaning pad and the charging roll which are fabricated in the examples 1 to 5 and the comparative examples 1 to 3 are mounted on the process cartridge for the color copying machine DocuCentre Color 400CP (made by Fuji Xerox Co., Ltd.) reconstructed to allow the cleaning roll for the charging roll to be mounted. After the process cartridge is left away for ten days in the environment of 30° C./75% RH, the charging roll is taken out, the rubber in the nip part and the non-nip part on the charging layer is cut in parallel to the axial direction of the conductive core, at equal intervals and three points, 3 mm square, and the silicone concentration in Si2p is measured using the photoelectron spectrometer JPS-9010MX (made by JEOL Ltd.).

(Evaluating the Uneven Density, Cleaning Property and Color Point After Storage)

Another process cartridge for measuring the silicone concentration is left away for ten days in the environment of 30° C./75% RH, and evaluated for the uneven density (image quality defect after storage) using the color copying machine DocuCentre Color 400CP (made by Fuji Xerox Co., Ltd.). After finishing, a print test is conducted for 10,000 sheets of A4 (made by Fuji Xerox, C2 sheet), and thereafter the occurrence of the uneven density (cleaning property evaluation) and the color point due to uneven cleaning for the charging roll is evaluated in halftone image quality according to the following criteria.

[Evaluation Criteria for Uneven Density]

A: No occurrence of uneven density in the image quality

B: Occurrence of uneven density in the image quality at permissible level

C: Occurrence of uneven density in the image quality at impermissible level

[Evaluation Criteria for Color Point]

A: No occurrence of uneven point in the image quality

C: Occurrence of color point in the image quality (Hydrolysis)

The cleaning roll left away for one month in the environment of 70° C./95% RH is touched by hand to check for deterioration and evaluated according to the following criteria.

A: Tensile strength of 85% or more

B: Tensile strength below 85%

The evaluation results of the examples 1 to 5 and the comparative examples 1 to 3 are shown in Table 1.

TABLE 1

| | Shape of charging member clean-up member | Material of charging member clean-up member | Cleaning with bleaching agent | Silicone foaming agent |
|---|---|---|---|---|
| Example 1 | Roll | EPM70 | 24 hr | Present |
| Example 2 | Roll | EPM70 | 8 hr | Present |
| Example 3 | Roll | EPM70 | 16 hr | Present |
| Example 4 | Roll | SP-80 | 16 hr | Present |
| Example 5 | Pad | EPM70 | 16 hr | Present |
| Comparative example 1 | Roll | EPM70 | None | Present |
| Comparative example 2 | Roll | RSM55 | None | None |
| Comparative example 3 | Roll | EPM70 | 60 hr | Present |

| | Difference between Max/Min of silicone concentration | Difference between Nip/Non Nip of silicone concentration | Image quality defect after storage (uneven density) |
|---|---|---|---|
| Example 1 | 1 atm % | 1 atm % | B |
| Example 2 | 3 atm % | 3 atm % | B |
| Example 3 | 2 atm % | 2 atm % | B |
| Example 4 | 2 atm % | 2 atm % | B |
| Example 5 | 2 atm % | 2 atm % | B |
| Comparative example 1 | 4 atm % | 4 atm % | C |
| Comparative example 2 | 0 atm % | 0 atm % | A |
| Comparative example 3 | <1 atm % | <1 atm % | A |

| | Cleaning property | Color point | Hydrolysis |
|---|---|---|---|
| Example 1 | A | A | A |
| Example 2 | A | A | A |
| Example 3 | A | A | A |
| Example 4 | B | A | B |
| Example 5 | A | A | A |
| Comparative example 1 | A | A | A |
| Comparative example 2 | B | C | B |
| Comparative example 3 | A | C | A |

From these results, if a difference between the maximum value and the minimum value of the silicone concentration in Si2p and a difference between the nip part and the non-nip part by the XPS analysis are made from 1 atm % to 3 atm %, the charging roll is less contaminated, and the occurrence of image quality defect such as uneven density and color point is suppressed even in a state where the charging member and the cleaning roll or cleaning pad are contacted in storage, while maintaining the cleaning property of the charging member. Also, in the example 4, the charging roll is less contaminated, and the occurrence of image quality defect such as uneven density and color point is suppressed, while maintaining the cleaning property of the charging roll, but a deterioration in the cleaning roll due to hydrolysis is observed.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A charging unit, comprising:

a charging member; and a charging member clean-up member having an elastic layer, the elastic layer containing a silicon oil, wherein a silicone concentration in analyzing the charging member by an x-ray photoelectron spectroscopy satisfies following condition:

about 1 atm %≦(difference between the maximum value and the minimum value of the silicone concentration in Si2p detected by the x-ray photoelectron spectroscopy above the charging member)≦about 3 atm %.

2. The charging unit according to claim 1, wherein the silicone concentration in analyzing the charging member by the x-ray photoelectron spectroscopy satisfies following condition:

about 1 atm %≦(difference between the maximum value and the minimum value of the silicone concentration in Si2p detected by the x-ray photoelectron spectroscopy above the charging member)≦about 2 atm %.

3. The charging unit according to claim 1, wherein the elastic layer contains a urethane foam.

4. The charging unit according to claim 1, wherein the elastic layer contains a polyether based polyurethane.

5. The charging unit according to claim 1, wherein the charging member clean-up member includes a core and the elastic layer, and the elastic layer is a cylindrical elastic layer formed around a periphery of the core.

6. A method for manufacturing the charging unit according to claim 1, comprising:

manufacturing a charging member clean-up member, the manufacturing process including forming an elastic layer and cleaning the elastic layer.

7. A process cartridge, comprising:

an image carrier and the charging unit according to claim 1.

8. An image forming device, comprising:

an image carrier;

the charging unit according to claim 1;

a latent image forming unit that forms a latent image on a surface of the image carrier;

a development unit that develops the latent image formed on the surface of the image carrier with a toner to form a toner image; and a transfer unit that transfers the toner image formed on the surface of the image carrier to a transferred body.

9. A charging unit, comprising:

a charging member; and a charging member clean-up member having an elastic layer, the elastic layer containing a silicon oil, wherein a silicone concentration in analyzing a contact part and a non-contact part of the charging member with the elastic layer by an x-ray photoelectron spectroscopy in a state where the elastic layer of the charging member clean-up member in unused state and the charging member in unused state are contacted for one day or more satisfies the following condition:

about 1 atm %≦(difference in the silicone concentration in Si2p between the contact part and the non-contact part of the charging member with the elastic layer detected by the x-ray photoelectron spectroscopy above the charging member)≦about 3 atm %.

10. The charging unit according to claim 9, wherein the silicone concentration in analyzing a contact part and a non-contact part of the charging member with the elastic layer by an x-ray photoelectron spectroscopy in a state where the elastic layer of the charging member clean-up member in unused state and the charging member in unused state are contacted for one day or more satisfies the following condition:

about 1 atm %≦(difference in the silicone concentration in Si2p between the contact part and the non-contact part of the charging member with the elastic layer detected by the x-ray photoelectron spectroscopy above the charging member)≦about 2 atm %.

11. The charging unit according to claim 9, wherein the elastic layer contains a urethane foam.

12. The charging unit according to claim 9, wherein the elastic layer contains a polyether based polyurethane.

13. The charging unit according to claim 9, wherein the charging member clean-up member includes a core and the elastic layer, and the elastic layer is a cylindrical elastic layer formed around a periphery of the core.

14. A method for manufacturing the charging unit according to claim 9, comprising:

manufacturing a charging member clean-up member, the manufacturing process including forming an elastic layer and cleaning the elastic layer.

15. A process cartridge, comprising:

an image carrier and the charging unit according to claim 9.

16. An image forming device, comprising:

an image carrier;

the charging unit according to claim 9;

a latent image forming unit that forms a latent image on a surface of the image carrier;

a development unit that develops the latent image formed on the surface of the image carrier with a toner to form a toner image; and a transfer unit that transfers the toner image formed on the surface of the image carrier to a transferred body.

* * * * *